US006691352B2

(12) United States Patent
Wang

(10) Patent No.: US 6,691,352 B2
(45) Date of Patent: Feb. 17, 2004

(54) ADJUSTABLE PILLOW

(76) Inventor: Long-Win Wang, 19506 Hinsdale Ave., Torrance, CA (US) 90503

( * ) Notice: Subject to any disclaimer, the term of this patent is extended or adjusted under 35 U.S.C. 154(b) by 0 days.

(21) Appl. No.: 10/155,119

(22) Filed: May 28, 2002

(65) Prior Publication Data

US 2002/0138908 A1 Oct. 3, 2002

Related U.S. Application Data

(63) Continuation-in-part of application No. 09/705,829, filed on Nov. 6, 2000, now abandoned.

(51) Int. Cl.[7] ..... A47C 27/02
(52) U.S. Cl. ..... 5/636; 5/644
(58) Field of Search ..... 5/636, 639, 640, 5/644, 656

(56) References Cited

U.S. PATENT DOCUMENTS 2,577,595 A * 12/1951 Tobias ..... 5/640
4,908,894 A * 3/1990 Sanders ..... 5/640
5,119,519 A * 6/1992 Foreman ..... 190/1
5,481,768 A * 1/1996 Shink ..... 5/645
5,809,594 A * 9/1998 Isogai ..... 5/644
6,009,557 A * 1/2000 Witta ..... 5/645

* cited by examiner

*Primary Examiner*—Teri Pham Luu
*Assistant Examiner*—Fredrick Conley
(74) *Attorney, Agent, or Firm*—Birch, Stewart, Kolasch & Birch, LLP

(57) ABSTRACT

An improved adjustable pillow includes a first pillow body which has a first opening and a second pillow body disposed at a selected location in the first opening. The first and second pillow bodies have a plurality of stuffing materials held therein. User may adjust the pillow to a height and curvature desired by shuffling the stuffing materials between the first and second pillow body and then wrap and fold the second pillow body to form a stable state for use. The second pillow body may be used to support user's neck to conform ergonomics and to enable the user to get most comfortable sleep.

17 Claims, 10 Drawing Sheets

ADJUSTABLE PILLOW

This application is a continuation-in-part of U.S. application Ser. No. 09/705,829, filed on Nov. 6, 2000 now abandoned.

BACKGROUND OF THE INVENTION

This invention relates to an adjustable pillow and particularly a pillow that enables a user to adjust the pillow to a height and curvature desired and to conform with ergonomics for the user to get most comfortable sleep.

People living in contemporary time usually experience a lot of working pressure and are constantly under high level of tension. To get enough rest after returning home is very important. The most effective rest is sleep. A sound sleep may relieve fatigue and replenish energy. Good sleeping posture and outfits may help people to get better sleep quality. Pillow is one of the common and essential sleeping outfits almost everyone needs in sleep. People always try to make and adjust the pillow to suit their needs and desire. There are a wide variety of pillows being made and used to suit different preference of people, ranging from hard shell pillows to soft pillows stuffing with fibers. Still, there is a continuous effort trying to make the pillow more comfortable, natural and healthy for people to get better quality sleep.

The most commonly used pillow is the one which has fibers stuffed in a fabric pillow case. The fibers is easy to deform under pressure. Hence after using a short period of time, the pillow becomes deformed and has uneven shape. Depending on user's sleeping habit and posture, some pillows become concave in the middle portion, while some others may become convex in the middle portion. When a person lies on one's back in sleep, the deformed pillow may twist the cervical vertebrae in a wrong way and cause undue pressure to vertebral nerve. User's bosom might be compressed and tension might be built in the muscles of the neck and shoulder. This will also affect normal breathing. The body thus cannot fully relax or rest. It is not uncommon that some people have sore neck or feel tired after wake up from a poor quality sleep. If the pressure persists for a prolong period of time, it might even produce spurs in the spine.

When a person lies in bed sideward, an ordinary pillow usually cannot provides sufficient support for the head and neck to rest at a right posture. The cervical vertebrae will be bent in a not healthy way. It will also produce pressure on the vertebral nerve and may result in poor quality sleep and sore of muscles in the neck and shoulder mentioned above.

SUMMARY OF THE INVENTION

It is therefore an object of this invention to resolve aforesaid disadvantages and to provide an improved pillow that is ergonomically designed and enables a person to adjust pillow height and curvature to suit his or her need and desire so that the person may have most comfortable sleep.

In one aspect, the pillow according to this invention includes a first pillow body which has a first opening communicating with a second pillow body. The first and second pillow body may be stuffed to form a plurality of pads, which may be adjusted to various forms desired. The second pillow body may also be set stable for supporting user's neck.

BRIEF DESCRIPTION OF THE DRAWINGS

The invention, as well as its many advantages, may be further understood by the following detailed description and drawings, in which.

DETAILED DESCRIPTION OF THE PREFERRED EMBODIMENTS

Figure 1:
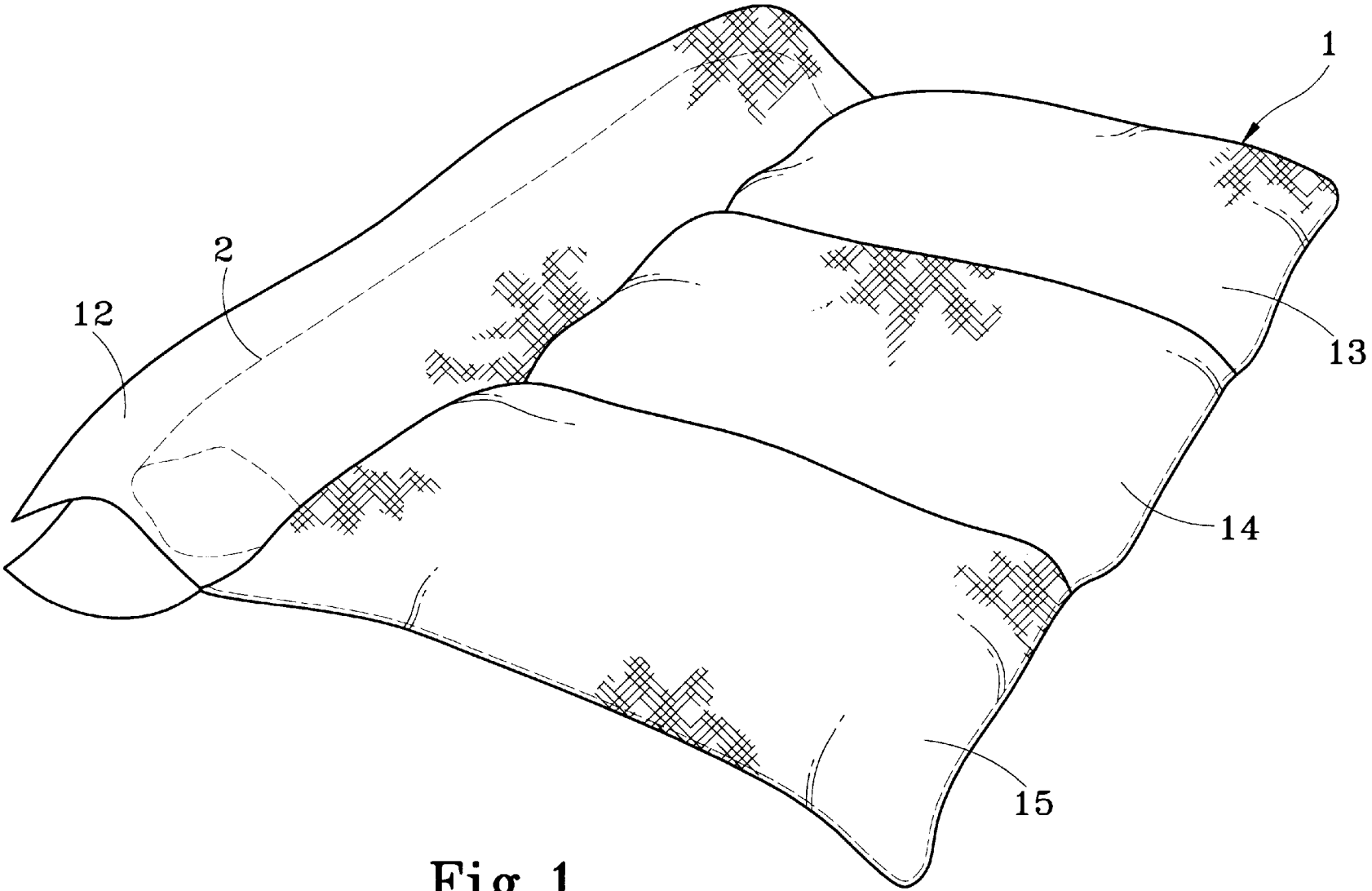
FIG. 1 is a perspective view of this invention.
Figure 2:
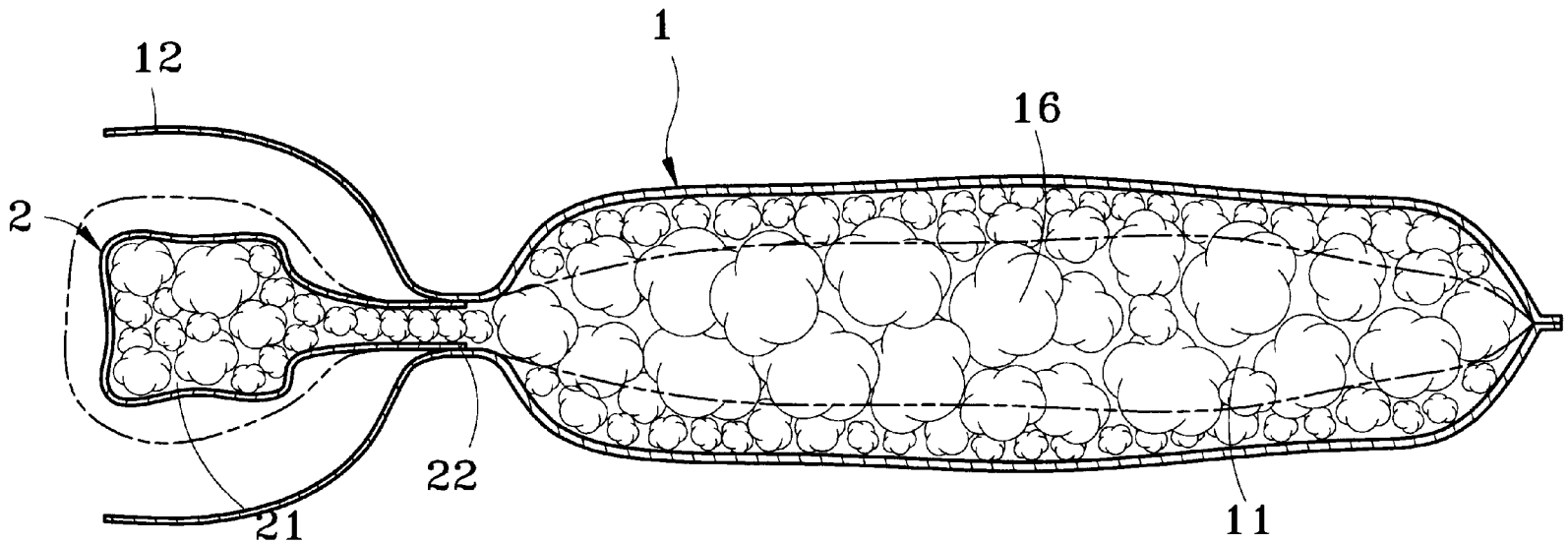
FIG. 2 is a sectional view of this invention.
Figure 3:
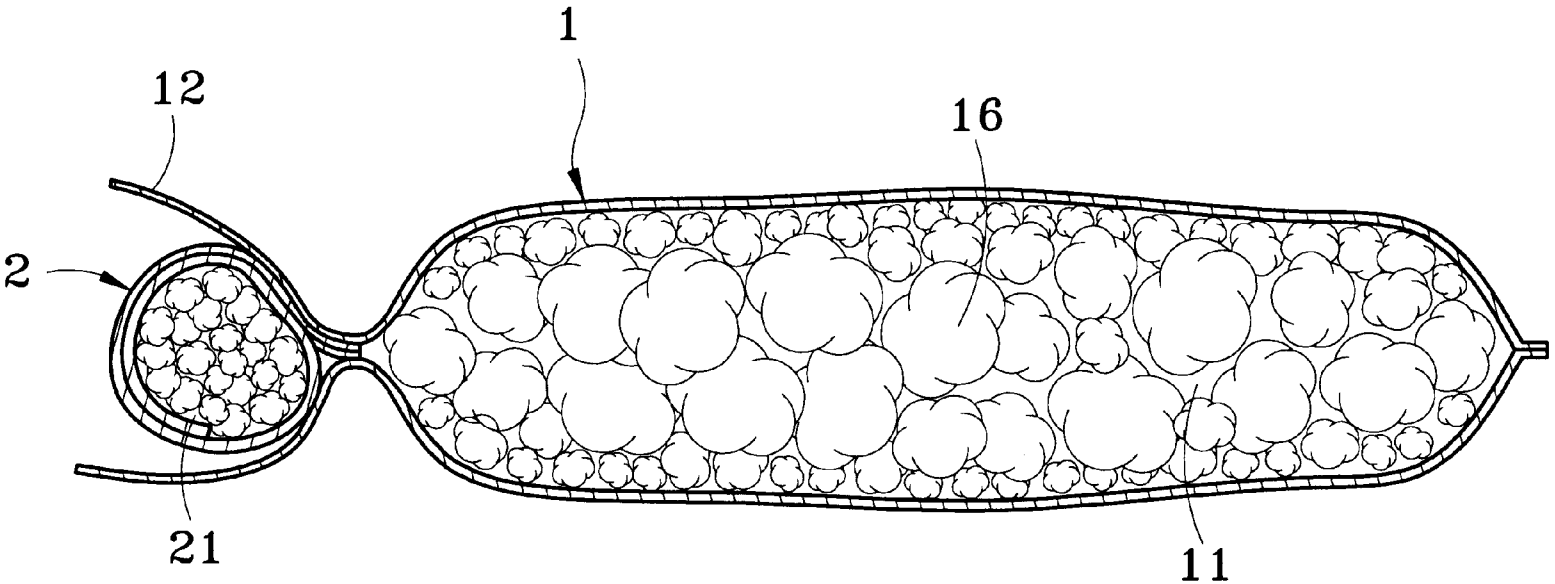
FIG. 3 is another sectional view of this invention, at a wrapped and folded state.

Referring to FIGS. 1, 2 and 3, the pillow according to this invention includes a first pillow body 1, a second pillow body 2 and a plurality of stuffing materials 16 filled inside the first and second pillow body 1 and 2. A user may adjust pillow height and curvature to suit user's need and preference. The second pillow body 2 may be wrapped and folded to cutoff communication with the first pillow body 1 to form a stable state. The second pillow body 2 may also become a pad for supporting user's neck. It thus conforms to ergonomics and may enable the user to get most comfortable and satisfactory sleep.

The first pillow body 1 has a first opening 12 at one end and a plurality of first compartments 11 which may form a plurality of pads 13, 14 and 15.

The second pillow body 2 has a second compartment 21 and a second opening 22 disposed at a selected location in the first opening 12 for the second compartment 21 to communicate with the pads 13, 14 and 15. The first and second compartments 11 and 21 are filled with the stuffing materials 16 which may be fibers, feather, green bean husks, buckwheat hulls, and the like. When the first and second pillow body 1 and 2 are at a communicating state (FIG. 2), the stuffing materials 16 inside the pads 13, 14, 15 and second compartment 21 may be shuffled between them so that the pillow body 1 and 2 may be adjusted to a height and curvature desired. For instance, for a person who wants to lie on back in sleep, that person may shuffle the stuffing materials 16 to the pad 14. For the person who wants to lie sideward, that person may shuffle the stuffing materials 16 to the pads 13 and 15 at two sides. Then the second pillow 2 may be wrapped and folded to stop communication between the second compartment 21 and the pads 13, 14 and 15 (FIG. 3). The folded second pillow 2 may be used to support user's neck.

Figure 4:
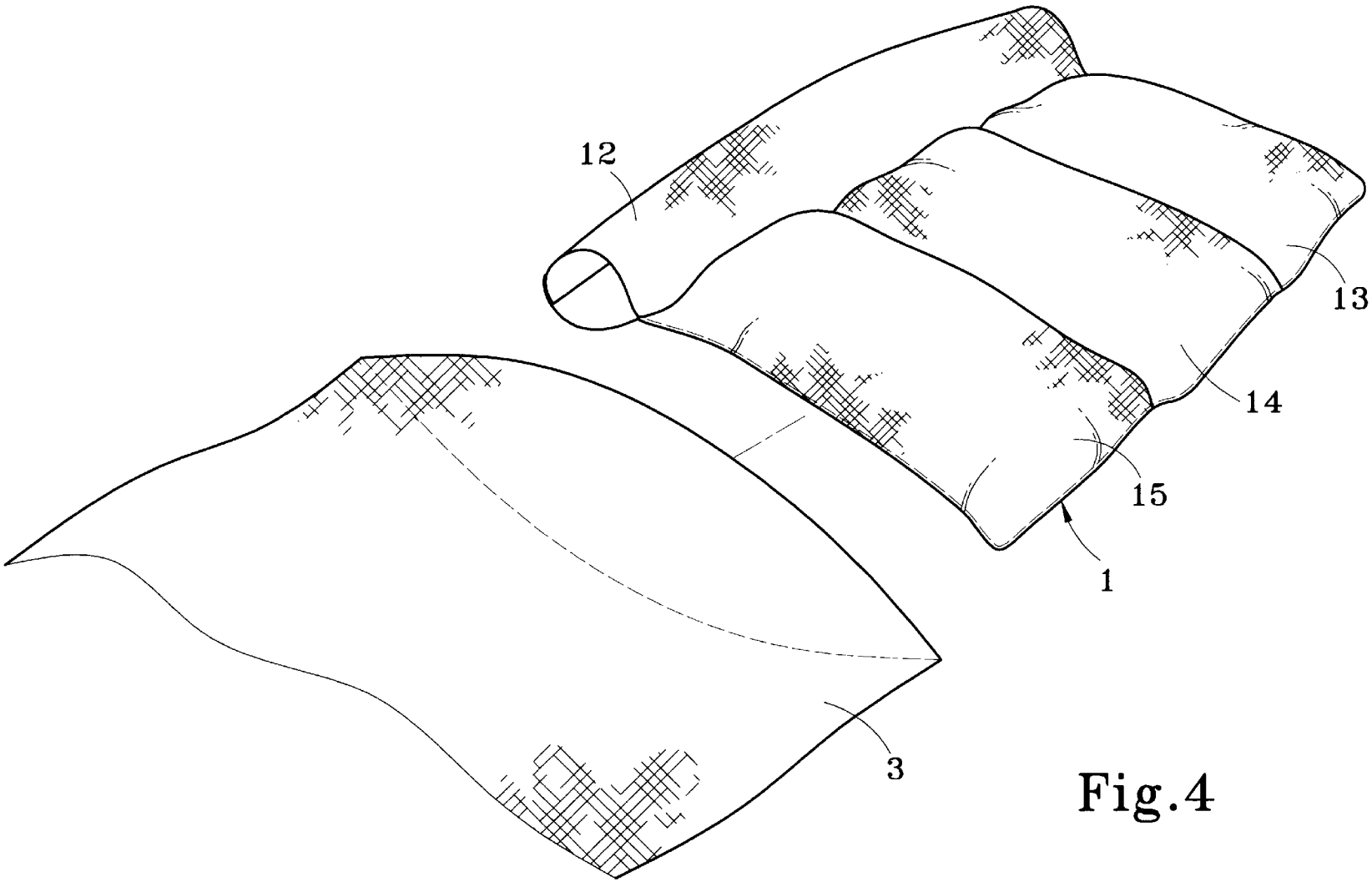
FIG. 4 is a perspective view of the first embodiment of this invention.

FIG. 4 shows the first embodiment of this invention. When a user has adjusted the first and second pillow body 1 and 2 to a height and curvature desired, the second pillow body 2 may be wrapped and folded securely. Then the combined pillow may be housed in a pillow case 3 so that the pillow will maintain at the height and curvature desired without deformation.

Figure 5:
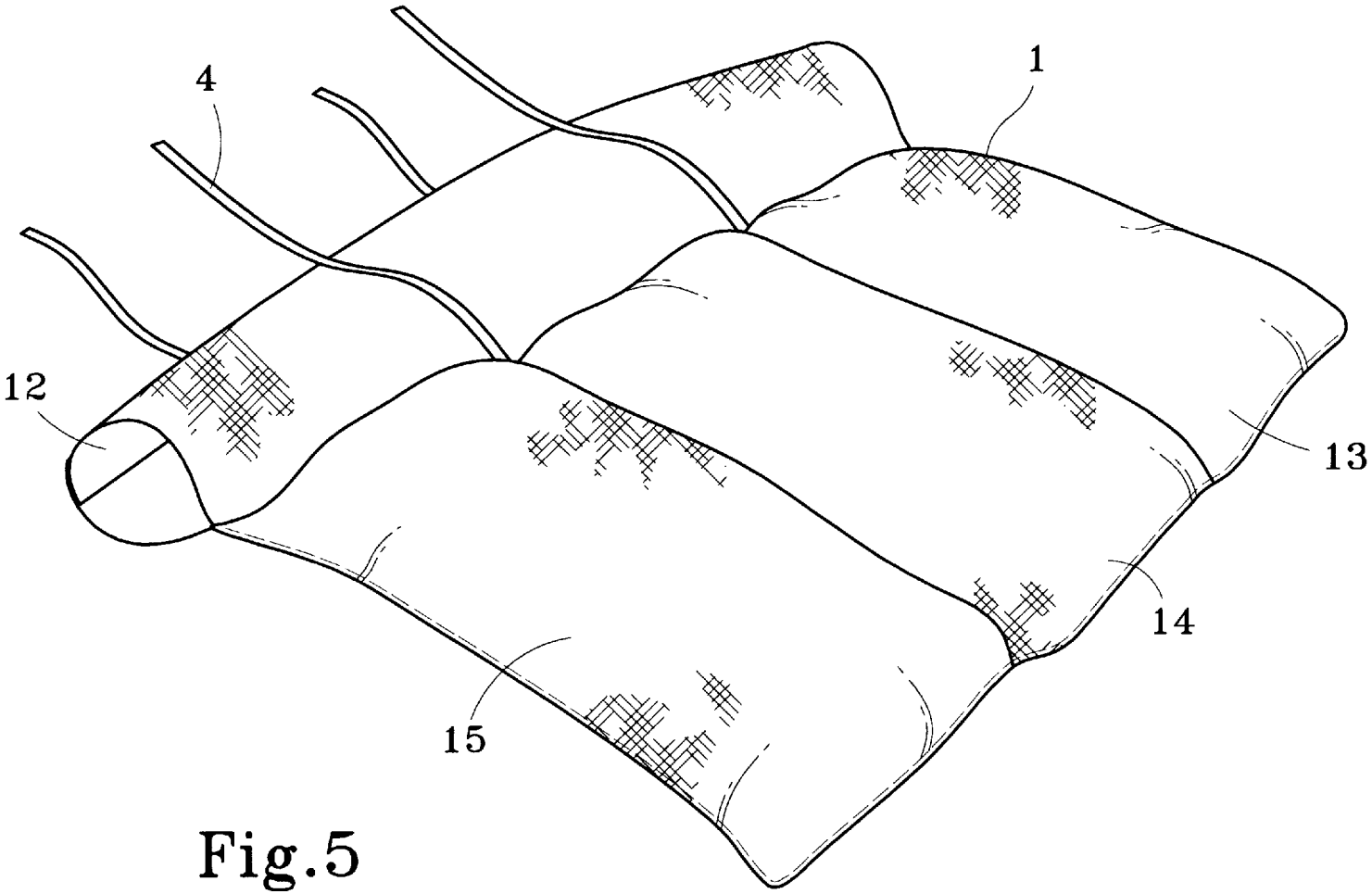
FIG. 5 is a perspective view of the second embodiment of this invention.
Figure 6:
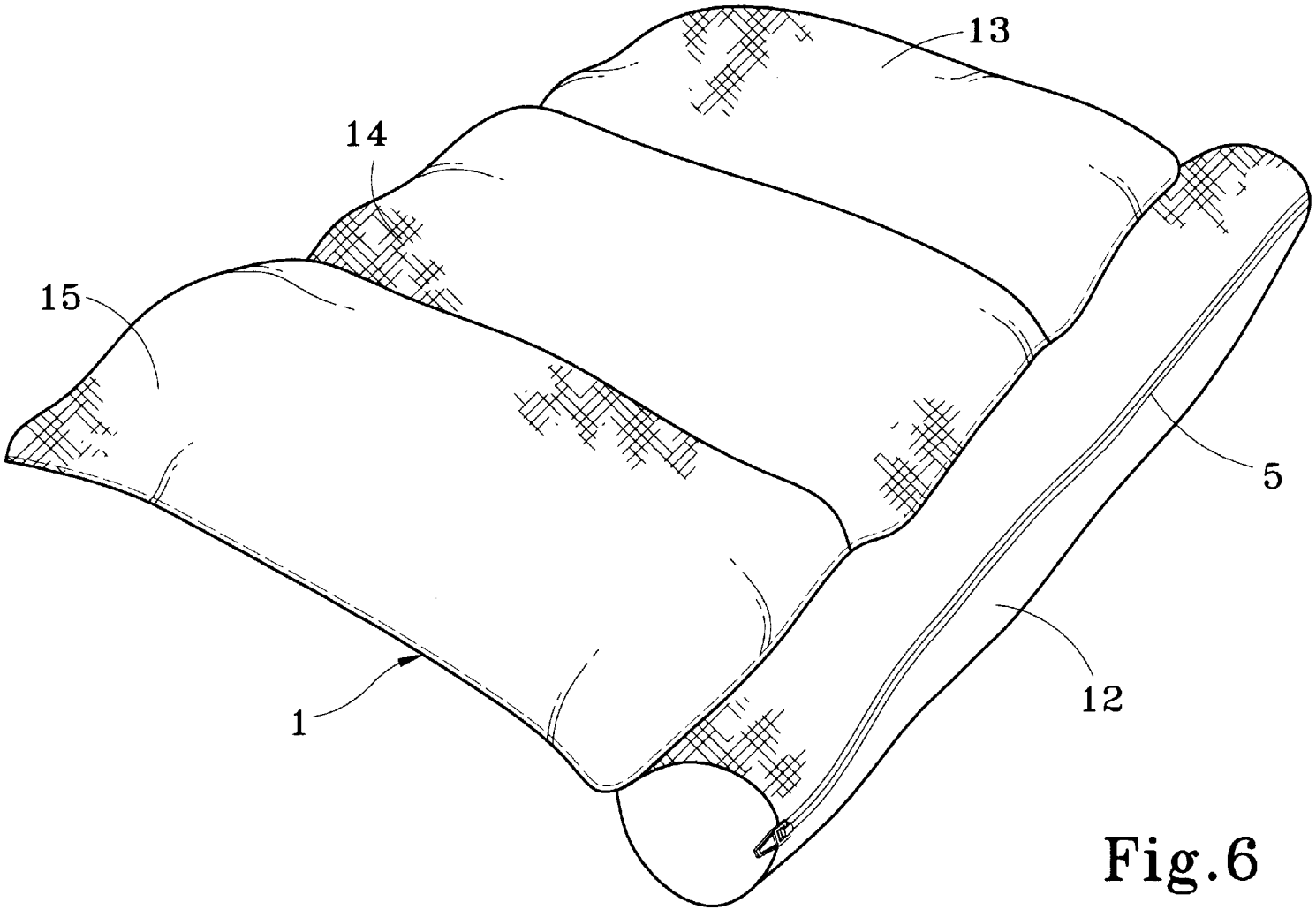
FIG. 6 is a perspective view of the third embodiment of this invention.
Figure 7:
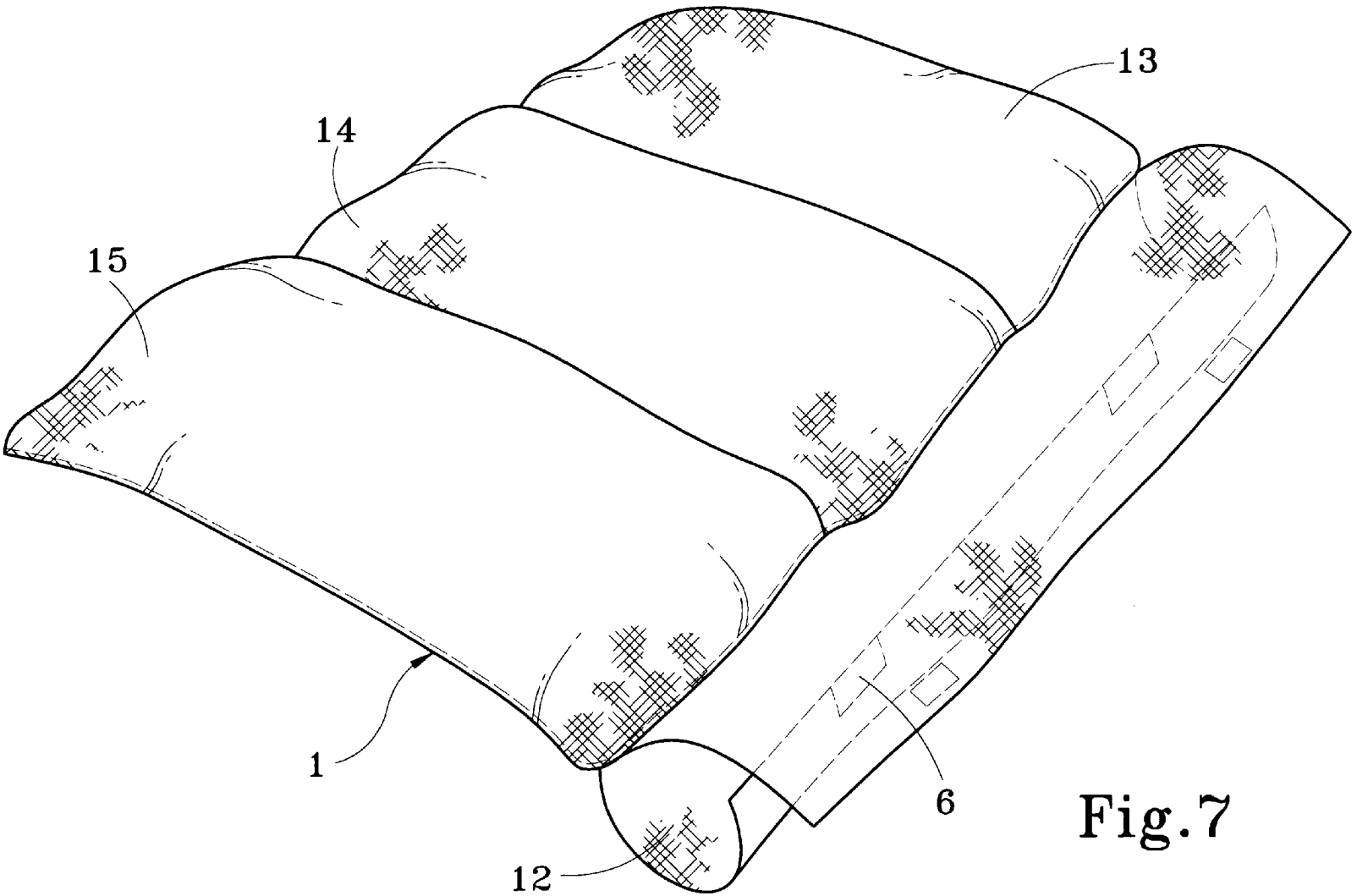
FIG. 7 is a perspective view of the fourth embodiment of this invention.
Figure 8:
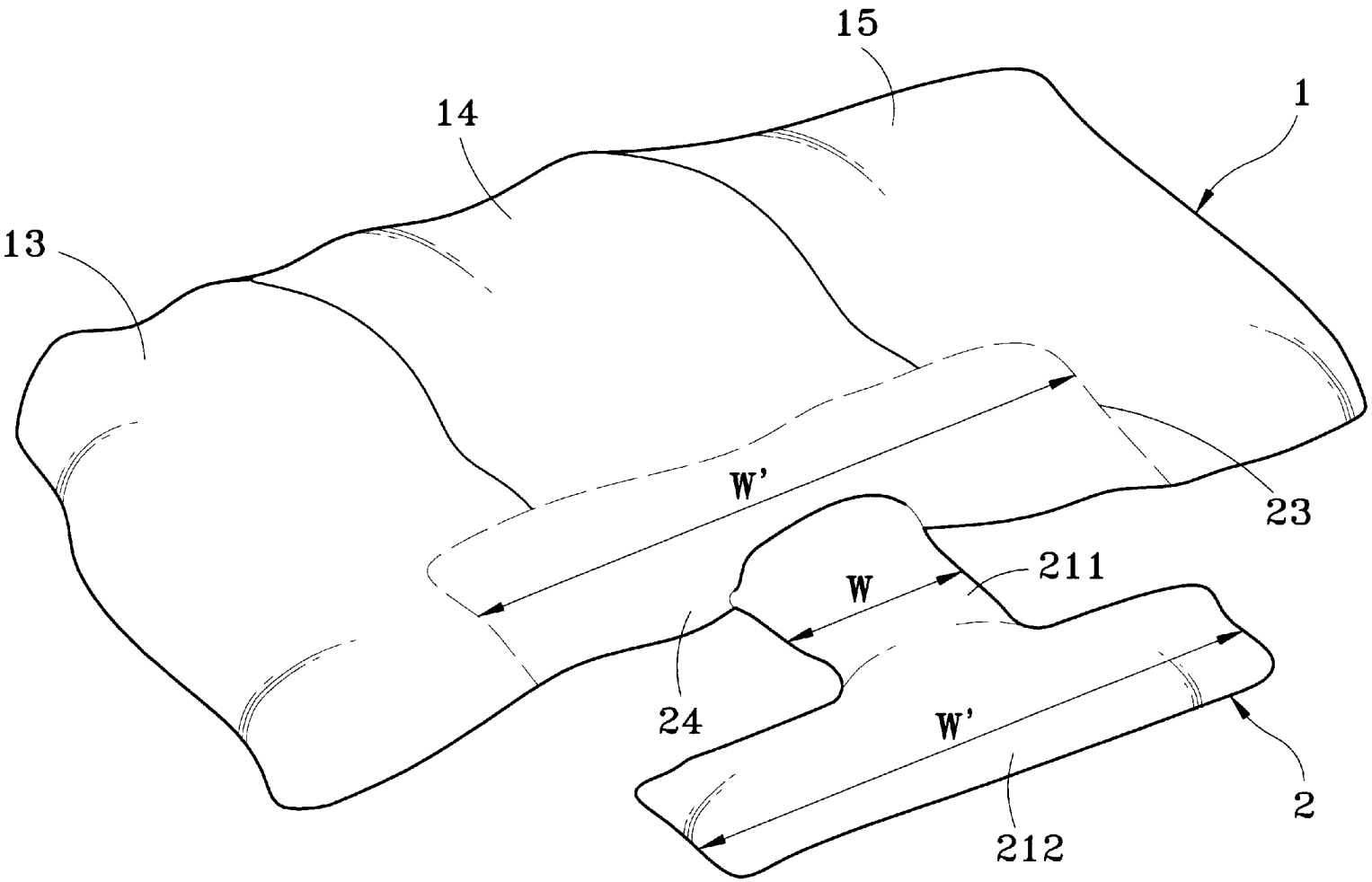
FIG. 8 is a perspective view of the fifth embodiment of this invention.
Figure 9:
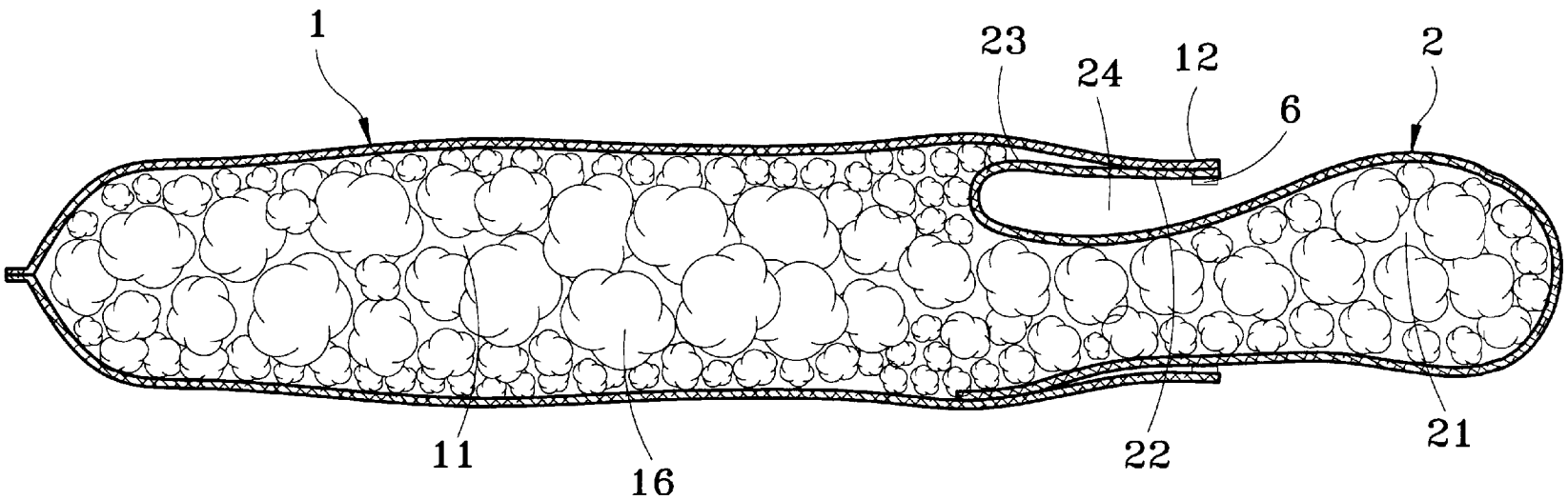
FIG. 9 is a sectional view of the fifth embodiment of this invention.
Figure 10:
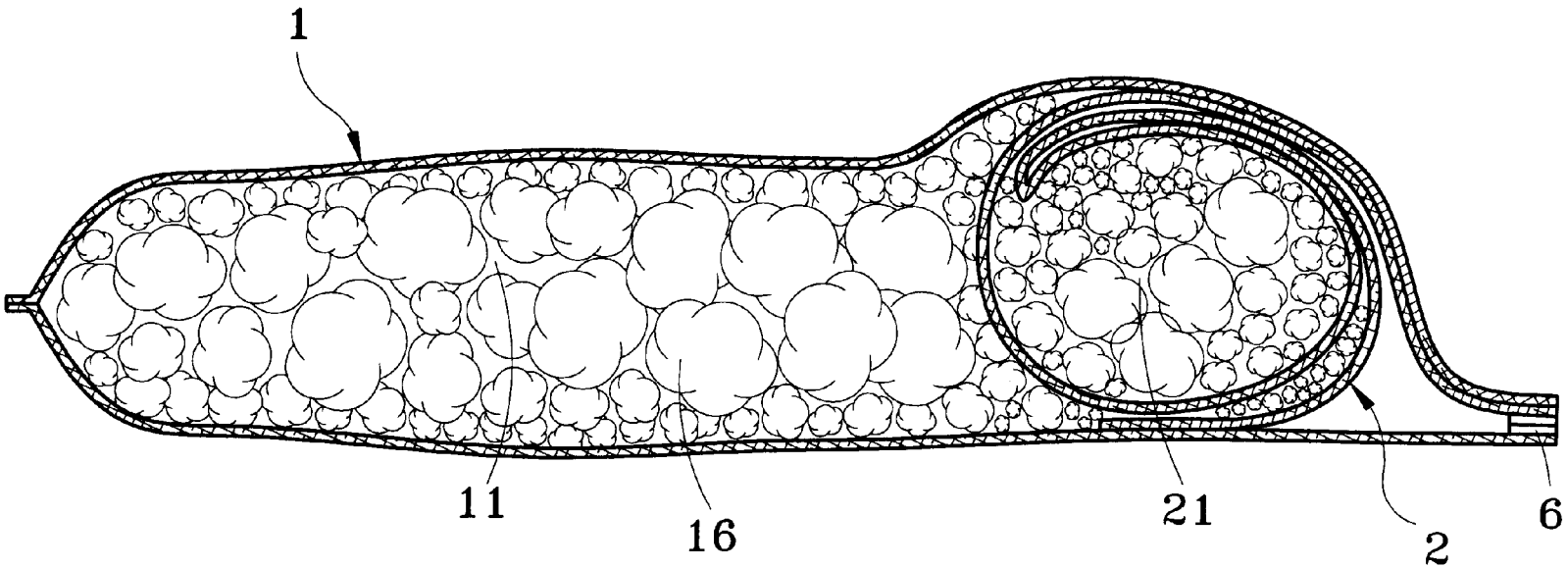
FIG. 10 is another sectional view of the fifth embodiment of this invention, at a wrapped and folded state.

FIG. 5 shows the second embodiment of this invention which has a plurality of straps 4 deployed on the first pillow body 1 to tie up the wrapped and folded second pillow body 2 in the first opening 12. FIG. 6 shows the third embodiment which has a fastening section 5, such as a zipper, deployed on the first opening 12 for holding the second pillow body 2 securely in the first opening 12 after the second pillow body 2 has been adjusted and folded. FIG. 7 shows the fourth embodiment which has Velcro strips 6 attached to the first opening 12 for holding the second pillow body 2 securely in the first opening 12. Once the pillow has been adjusted to the height and curvature desired, the structure and features indicated in the embodiments set forth above may help to maintain the pillow at a stable state without deformation. The wrapped and folded second pillow body 2 may be used to support user's neck to add more comfort to the user. Please refer to FIGS. 8, 9 and 10, which respectively shows a perspective view of the fifth embodiment of this invention, a sectional view thereof, and another sectional view thereof at a wrapped and folded state. The second pillow body 2 further includes an inner pocket 23 formed at one side of the second opening 22. The inner pocket 23 has a third compartment 24 for receiving the second pillow body 2. When the first and second pillow body 1 and 2 are at a communicating state (FIG. 9), the stuffing materials 16 inside the pads 13, 14, 15 and second compartment 21 may be shuffled between them so that the pillow body 1 and 2 may be adjusted to a height and curvature desired. As shown in FIG. 10, when an user intend to adjust the pillow body 1 and 2 to a height and curvature desired, he just needs to shuffle the stuffing materials 16 held in the first compartments 11 and second compartment 21. Thereafter, the second pillow body 2 is wrapped and folded to cutoff communication with the first pillow body 1 to form a stable state. Finally, the second pillow body 2 is put into the third compartment 24 and securely held in the third compartment 24 via a plurality of Velcro strips 6. Alternatively, a fastening section, such as a zipper, a plurality of hooks and loops, a plurality of straps and a plurality of buttons disposed at selected locations, e.g. on the first and the second openings, (not shown) may be applied to hold the second pillow body 2 in the third compartment 24 too. Certainly, as shown in FIG. 8, because the width (W) of a connecting portion 211 of the second pillow body 2 is shorter than that (W') of a main portion 212 of the second pillow body 2 and that (W') of the pocket 23, the second pillow body 2 could still be securely held in the third compartment 24 even if no Velcro strips, fastening sections, hooks and loops, straps or buttons are included at selected locations.

It may thus be seen that through the adjustable pillow of this invention an user may adjust the pillow easily to suit his or her need and desire, and may get more comfortable and better quality sleep. The object of the invention set forth herein, as well as those made apparent from the foregoing description, thus is efficiently attained.

What is claimed is:

1. An adjustable pillow, comprising:

a first pillow body having a first opening at one end thereof and a plurality of first compartments to form a plurality of pads, the first compartments having a stuffing material held therein, a second pillow body having a second compartment and a second opening disposed at a selected location in the first opening for the second compartment to communicate with the first compartments, the second compartment having the stuffing material held therein, and said second pillow body including an inner pocket formed at one side of said second opening, wherein the stuffing materials held in the first compartments and second compartment may be shuffled so that a user may adjust the pillow to a height and curvature desired, then wrap and fold the second pillow body to form a stable state, the second pillow body may be used for-supporting the user's neck to conform ergonomics.

2. The adjustable pillow according to claim 1, wherein the stuffing material is selected from the group consisting of fibers, feather, green bean husks, and buckwheat hulls.

3. The adjustable pillow according to claim 1, wherein the pillow is housed in a pillow case after having been adjusted.

4. The adjustable pillow according to claim 1, wherein the first pillow body has a plurality of straps disposed at selected locations for holding and securing the adjusted second pillow body.

5. The adjustable pillow according to claim 1, wherein the first opening has a fastening section for holding and securing the adjusted second pillow body.

6. The adjustable pillow according to claim 5, wherein the fastening section is a zipper.

7. The adjustable pillow according to claim 1, wherein the first opening has Velcro strips attached thereon for holding and securing the adjusted second pillow body.

8. The adjustable pillow according to claim 1, wherein the inner pocket has a third compartment for receiving the second pillow body.

9. The adjustable pillow according to claim 8, wherein the first and the second openings has Velcro strips attached thereon for holding and securing the adjusted second pillow body.

10. The adjustable pillow according to claim 8, wherein the first and the second openings has a plurality of hooks and loops disposed at selected locations for holding and securing the adjusted second pillow body.

11. The adjustable pillow according to claim 8, wherein the first and the second openings has a plurality of buttons disposed at selected locations for holding and securing the adjusted second pillow body.

12. The adjustable pillow according to claim 8, wherein the first and the second openings has a plurality of straps disposed at selected locations for holding and securing the adjusted second pillow body.

13. The adjustable pillow according to claim 8, wherein the first and the second openings has a fastening section for holding and securing the adjusted second pillow body.

14. The adjustable pillow according to claim 13, wherein the fastening section is a zipper.

15. The adjustable pillow according to claim 1, wherein the first opening has a plurality of hooks and loops disposed thereon for holding and securing the adjusted second pillow body.

16. The adjustable pillow according to claim 1, wherein the first opening has a plurality of buttons disposed thereon for further holding and securing the second pillow body.

17. The adjustable pillow according to claim 1, wherein the first opening has a plurality of straps disposed at selected locations for further holding and securing the second pillow body.

* * * * *